US009668619B2

(12) United States Patent
Sterling

(10) Patent No.: US 9,668,619 B2
(45) Date of Patent: Jun. 6, 2017

(54) BAFFLED CHAMBER BATHING DEVICE AND METHODS

(71) Applicant: Hayley Matzko Sterling, McLean, VA (US)

(72) Inventor: Hayley Matzko Sterling, McLean, VA (US)

( * ) Notice: Subject to any disclaimer, the term of this patent is extended or adjusted under 35 U.S.C. 154(b) by 18 days.

(21) Appl. No.: 15/182,834

(22) Filed: Jun. 15, 2016

(65) Prior Publication Data

US 2016/0360936 A1 Dec. 15, 2016

Related U.S. Application Data

(60) Provisional application No. 62/175,969, filed on Jun. 15, 2015.

(51) Int. Cl.
*A47K 7/02* (2006.01)
*A47K 7/03* (2006.01)

(52) U.S. Cl.
CPC ..... *A47K 7/03* (2013.01); *A47K 7/022* (2013.01)

(58) Field of Classification Search
CPC ..... A47K 7/022; A47K 7/03
USPC ..... 401/6, 201
See application file for complete search history.

(56) References Cited

U.S. PATENT DOCUMENTS

| | | | | |
|---|---|---|---|---|
| 1,345,026 | A | | 6/1920 | Riley |
| 1,386,041 | A | | 8/1921 | Wilson |
| 2,035,014 | A | | 3/1936 | Schaefer |
| 2,730,745 | A | * | 1/1956 | Norman ..... A47K 7/03 132/312 |
| 3,674,374 | A | | 7/1972 | Jennings |
| 3,720,205 | A | | 3/1973 | Liebman |
| 3,959,841 | A | | 6/1976 | Horne |
| 3,977,796 | A | | 8/1976 | Gillespie et al. |
| 5,326,610 | A | | 7/1994 | Moss |
| 5,509,164 | A | | 4/1996 | Weill |
| 5,545,456 | A | | 8/1996 | Suida |
| 6,209,165 | B1 | | 4/2001 | Frolova |
| 6,227,742 | B1 | | 5/2001 | Corn et al. |
| 6,644,881 | B1 | | 11/2003 | Dawan |
| 6,849,055 | B1 | | 2/2005 | Williams |
| 2008/0205962 | A1 | | 8/2008 | Wilson |
| 2013/0098381 | A1 | | 4/2013 | McBrayer |

* cited by examiner

*Primary Examiner* — David Walczak
*Assistant Examiner* — Joshua Wiljanen
(74) *Attorney, Agent, or Firm* — PK Patent Law

(57) ABSTRACT

A baffled chamber bathing device and a method of making same are provided. The baffled chamber bathing device includes a generally elongated piece of porous fabric having a length. The piece of porous fabric can be folded along its length along a first fold and a second fold to form a tri-folded structure having a width. The bathing device includes a plurality of dividers each extending laterally across the width of the tri-folded structure and which define a plurality of baffled chambers. At least one of the plurality of baffled chambers created by the tri-folded structure and the plurality of dividers includes an opening into which a soap segment is capable of being inserted and securely held within the respective baffled chambers by the tri-folded structure.

22 Claims, 7 Drawing Sheets

BAFFLED CHAMBER BATHING DEVICE AND METHODS

CROSS REFERENCE TO RELATED APPLICATION

The present application claims the benefit from earlier filed U.S. Provisional Patent Application No. 62/175,969, filed Jun. 15, 2015, which is incorporated herein in its entirety by reference.

FIELD OF THE INVENTION

The present teachings relate to a bathing device. In particular, the present teachings relate to a bathing device that can hold pieces of soap and can be used to stimulate and exfoliate new skin growth and clean a user's skin.

BACKGROUND OF THE INVENTION

Known bathing face cloths, soap latherers, or soap holders depend on draw strings which can flop, untie, or get moldy. Moreover, known bathing devices are made of plastic-type containers or netting, which can lather but feel inorganic and artificial to the skin. Many known bathing devices also lack esthetic beauty.

Accordingly, there exists a need for an aesthetically pleasing bathing device that can hold any size of soap bar thus eliminating soap waste, offers various health benefits by maintaining skin health, and can drip-dry preventing frequent laundering.

SUMMARY OF THE INVENTION

The present teachings provide a baffled chamber bathing device including a generally elongated piece of porous fabric having a length. The piece of porous fabric can be folded along its length along a first fold and a second fold thereby forming a tri-folded structure having a width. A plurality of dividers can each extend laterally across the width of the tri-folded structure and can define a plurality of baffled chambers within the tri-folded structure. At least one of the plurality of baffled chambers created by the tri-folded structure and the plurality of dividers can include an opening into which a soap segment is capable of being inserted and securely held within the respective baffled chambers by the tri-folded structure.

The present teachings also provide a baffled chamber bathing device including a generally elongated piece of fabric folded along a first fold, $F_1$, and a second fold, $F_2$, to create a tri-folded structure having a width. Each of the first fold, $F_1$, and the second fold, $F_2$, can be located a different distance from a corresponding first edge and second edge of the elongated piece of fabric and each distance being less than the width of the tri-folded structure. A plurality of dividers can each extend laterally across the width of the tri-folded structure and can define a plurality of baffled chambers within the tri-folded structure. At least one of the plurality of baffled chambers created by the tri-folded structure and the plurality of dividers can include an opening into which a soap segment is capable of being inserted and securely held within the respective baffled chambers by the tri-folded structure.

The present teachings further provide a method of making a baffled chamber bathing device including providing a generally elongated piece of fabric. The method includes folding the piece of fabric along a first fold, $F_1$, located at a first distance from a corresponding first edge of the elongated piece of fabric. The method further includes folding the piece of fabric along a second fold, $F_2$, located at a second distance from a corresponding second edge of the elongated piece of fabric and different from the first distance to thereby create a tri-folded structure having a width. The method still further includes providing a plurality of dividers each extending laterally across the width of the tri-folded structure and defining a plurality of baffled chambers within the tri-folded structure. Each of the first distance and the second distance are less than the width of the tri-folded structure. Moreover, at least one of the plurality of baffled chambers created by the tri-folded structure and the plurality of dividers includes an opening into which a soap segment is capable of being inserted and securely held within the respective baffled chambers by the tri-folded structure.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
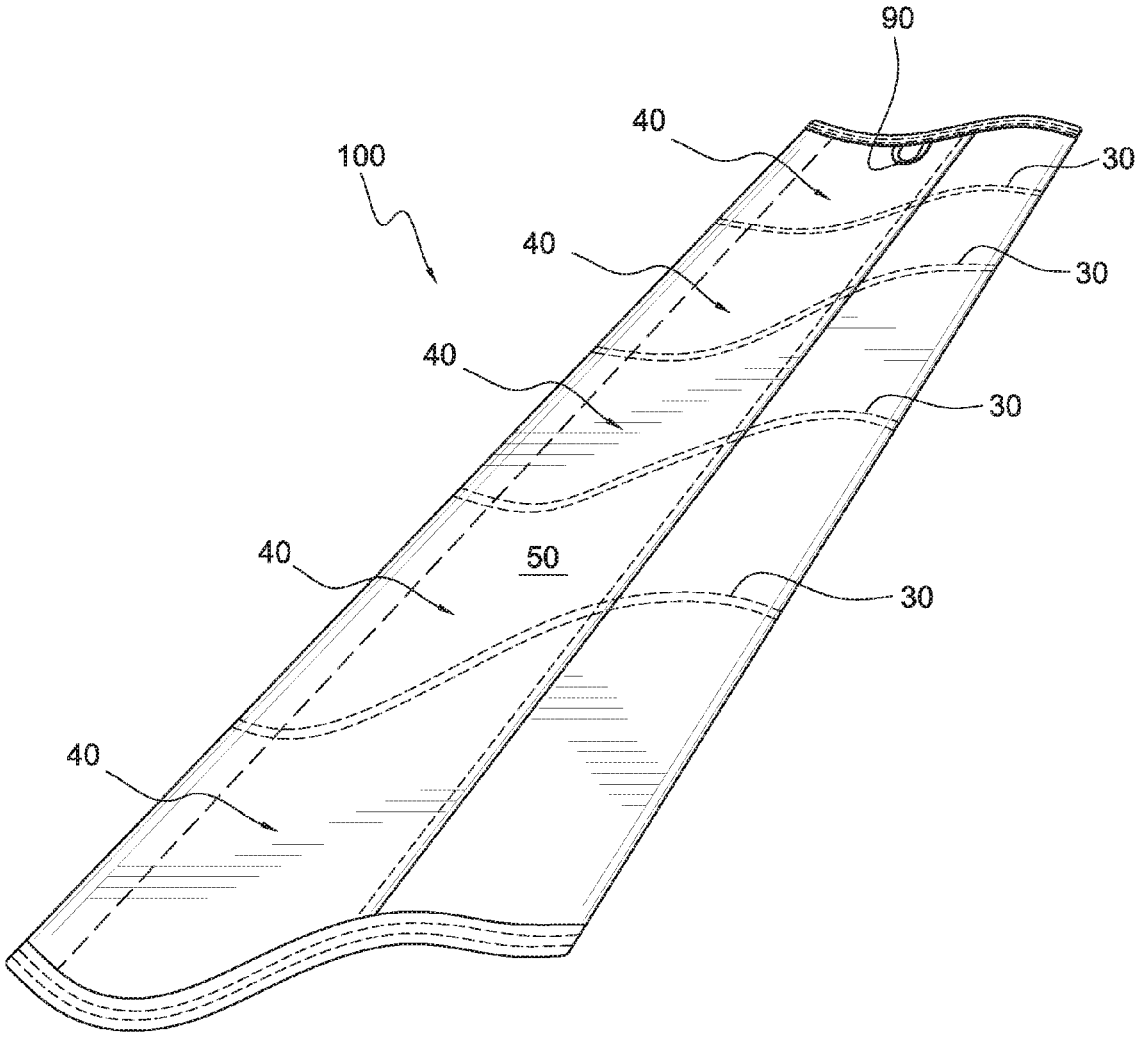
FIG. 1 shows a perspective view of the baffled chamber bathing device of the present teachings.
Figure 2:
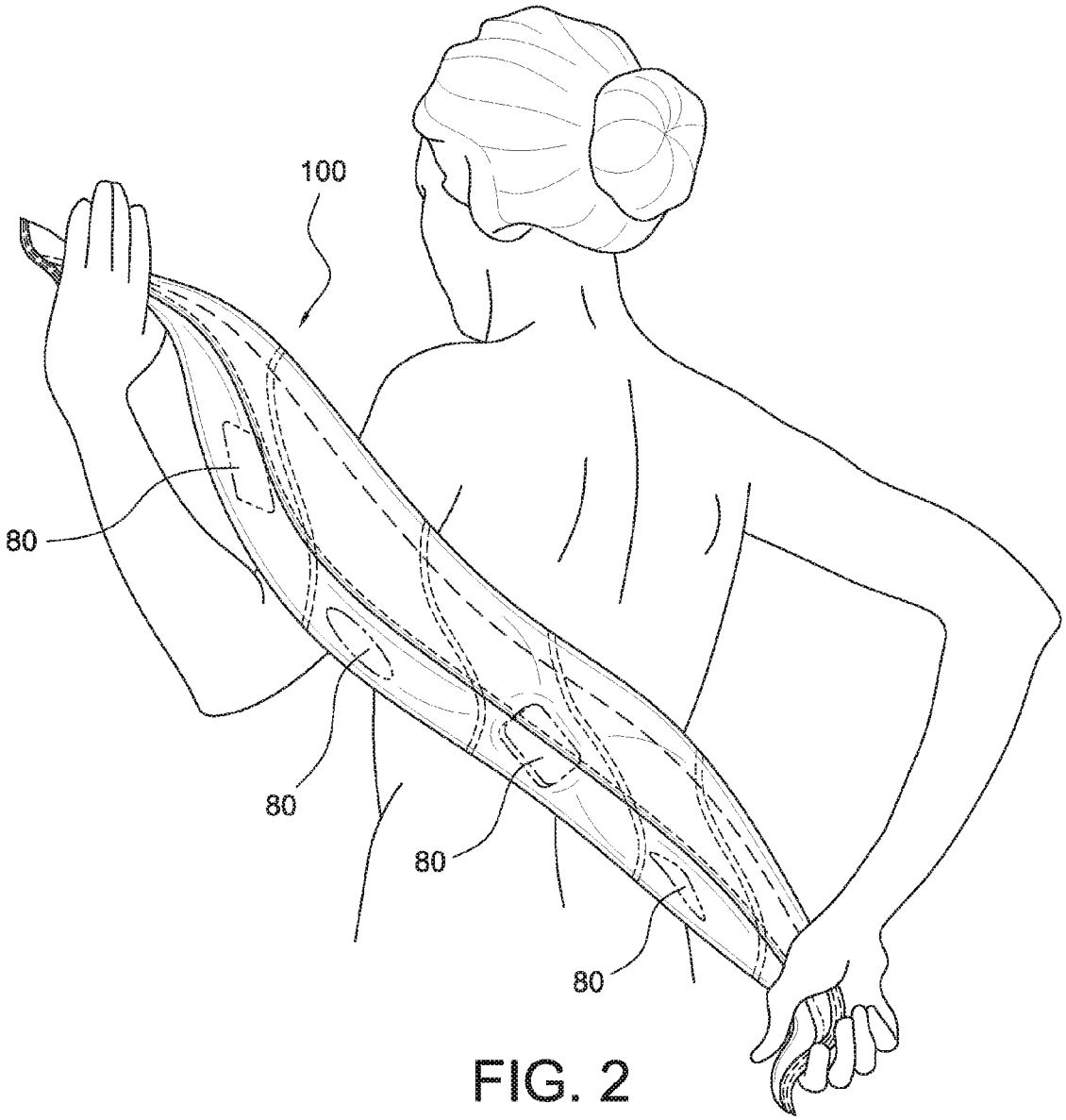
FIG. 2 shows the baffled chamber bathing device of the present teachings in use.

As shown in FIGS. 1 and 2, the present teachings relate to a multi-compartment baffled chamber bathing device 100 that can be used for skin rejuvenation, circulation, debridement, and deep-clean bathing. The baffled chamber bathing device 100 can be made from a porous and textured type of antibacterial type fabric 50 that can have an array of designs, patterns, and types of textures. As will be described in detail below, the baffled chamber bathing device 100 has a tri-folded design and can include a series of S-shaped dividers 30 that create a series of baffled chambers, sleeves, or pockets 40 into which soap segments 80 can be inserted and securely held during bathing or showing.

Figure 3:
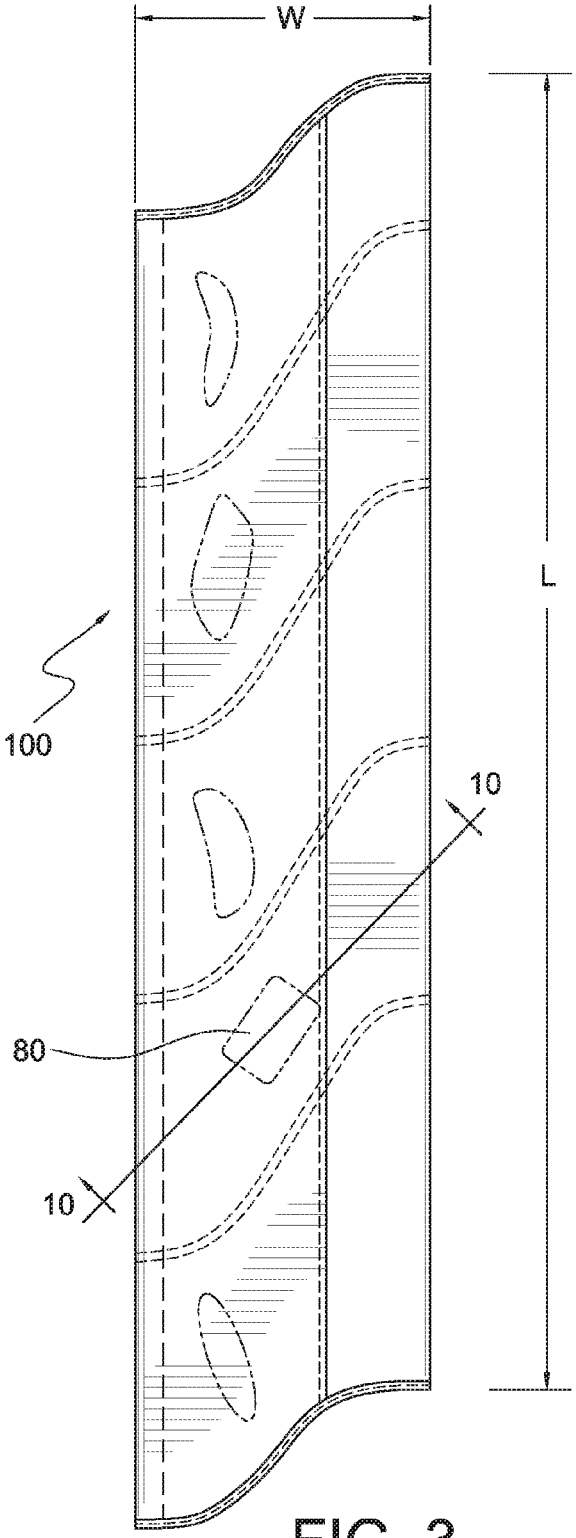
FIGS. 3 and 4 show top plan views of the baffled chamber bathing device in longer and shorter versions, respectively.
Figure 4:
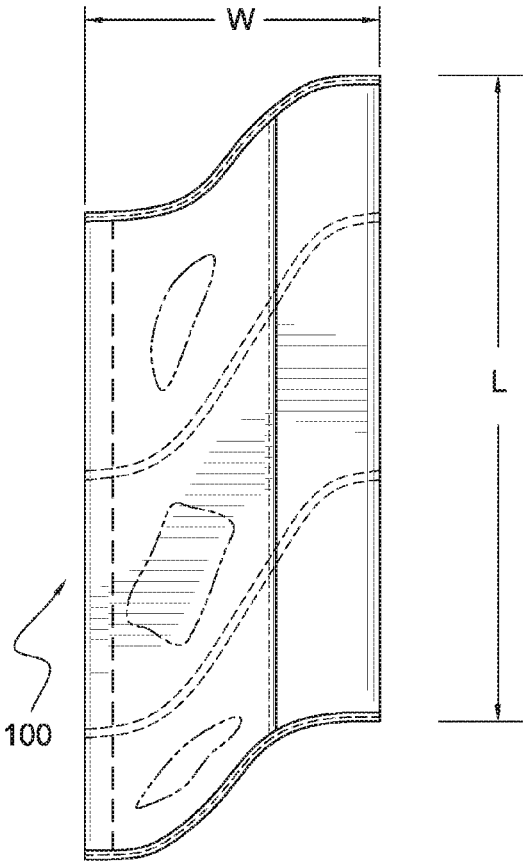

As shown in FIGS. 3 and 4, the baffled chamber bathing device 100 of the present teachings can include a length, L, and a width, W. A standard longer-sized bathing device 100 is shown in FIG. 3 while a shorter version is shown in FIG. 4. The structure and features of both the standard longer-sized bathing device and the shorter version are substantially identical other than the length and the number of pockets 40 arranged in the bathing device 100.

Referring to FIG. 3, the standard longer-sized bathing device 100 of the present teachings can have a length, L, from about 36 inches to about 44 inches, and preferably, the length, L, can be about 39 inches. A width, W, can be from about 7 inches to about 9 inches, and preferably, the width, W, can be about 7.25 inches.

Referring to FIG. 4, the shorter version of the bathing device 100 of the present teachings can include a length, L, from about 15 inches to about 28 inches, and preferably, the length, L, can be about 23.75 inches. A width, W, can be from about 7 inches to about 9 inches, and preferably, the width, W, can be about 7.25 inches.

Figure 5:
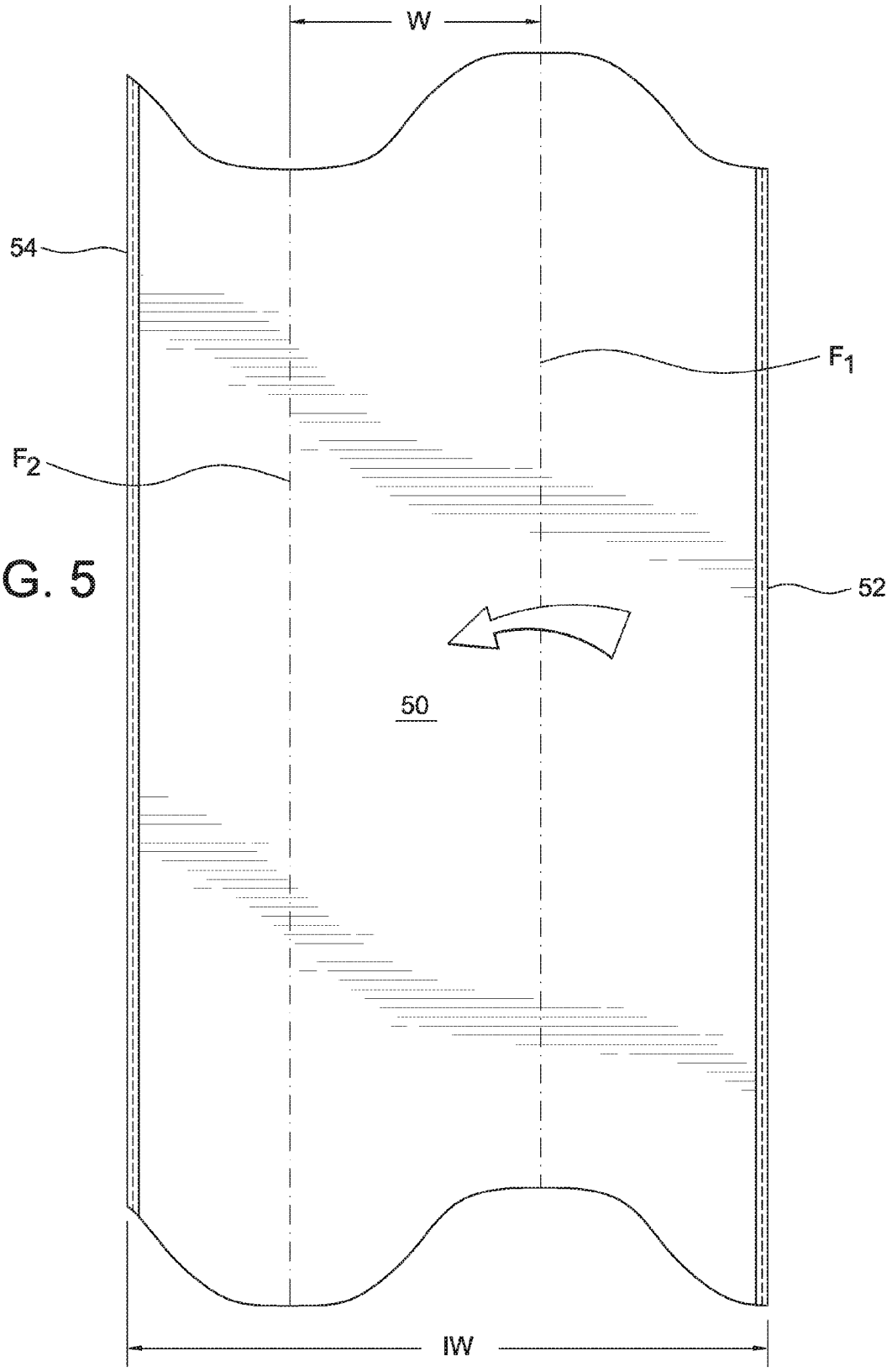
FIGS. 5-9 show folding steps used in a method of making the baffled chamber bathing device of the present teachings from a single piece of fabric.
Figure 6:
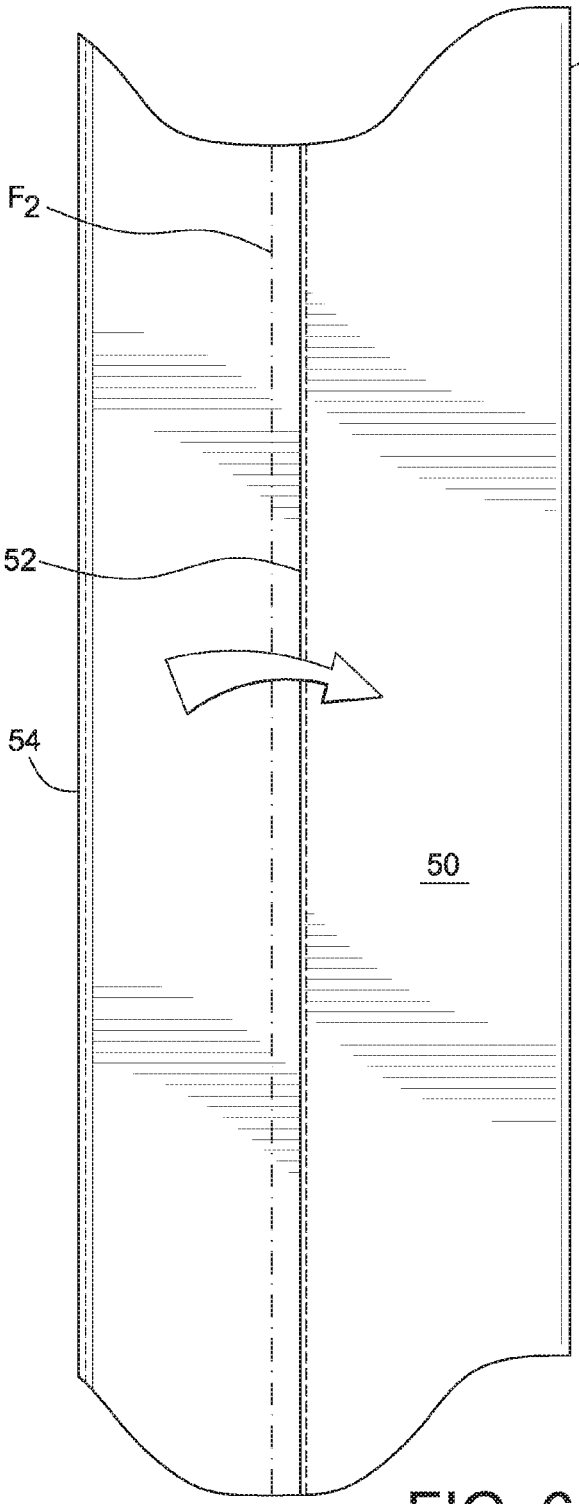
Figure 7:
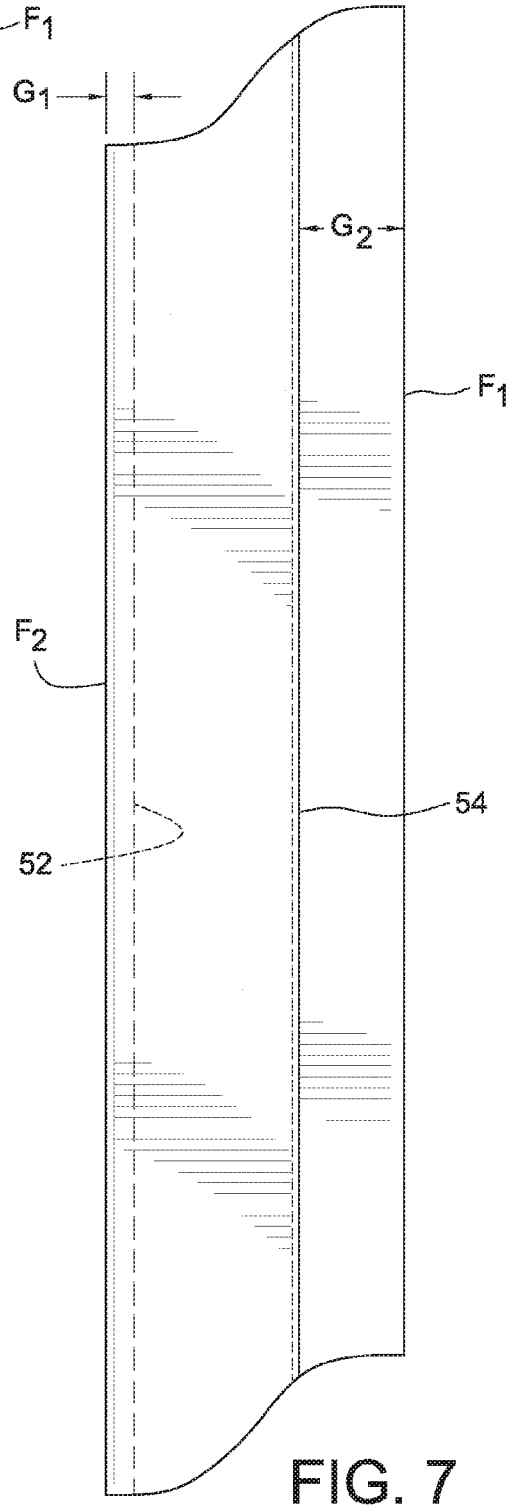

The baffled chamber bathing device 100 can be made from a single piece of fabric 50 which is sequentially folded into a tri-fold arrangement, as is shown in FIGS. 5-7. FIGS. 5-7 will be described herein using dimensions that creates a baffled chamber bathing device 100 having a final width, W, of about 7.25 inches. In FIG. 5, the single piece of fabric 50 can have an initial width, IW, of about 19.25 inches.

A first fold, $F_1$, can be made at about 6.75 inches from a first edge 52 of the fabric 50. A second fold, $F_2$, can be made at about 5.25 inches from a second edge 54 of the fabric 50.

More particularly, as shown by way of the arrow in FIG. 5, the initial fold, $F_1$, can be made at a distance of about 6.75 inches from the first edge 52 located along the length, L, of the fabric piece 50.

Next, as shown by way of the arrow in FIG. 6, a second fold, $F_2$, can be made at a distance of about 5.25 inches from the second edge 54 of the fabric piece 50. This results in a flap of fabric extending over the two previously folded fabric layers created by the initial fold, $F_1$, and creates the tri-folded structure. In addition, the location of the folds, $F_1$ and $F_2$, results in the formation of an interior gap, $G_1$ (for example, $G_1$, can be about 0.5 inches), between the first edge 52 and the second fold, $F_2$, which limits entry and exit from each of the plurality of pockets 40 as will be described in more detail below.

FIG. 7 shows the fabric 50 after it is folded along the first and second folds, $F_1$, $F_2$, and the formation of the tri-folded structure. The folds, $F_1$ and $F_2$, also create an exterior gap, $G_2$, (for example, $G_2$, can be about 2 inches), between the fold, $F_1$, and the second edge 54 of the fabric 50. As will be described in more detail below, the exterior gap, $G_2$, forms the initial openings 70 into each of the plurality of pockets 40 created within the tri-folded fabric 50.

The interior gap, $G_1$, and the exterior gap, $G_2$, are formed by locating each of the first fold, $F_1$, and the second fold, $F_2$, at different distances from respective first edge 52 and second edge 54 of the elongated piece of fabric 50. More particularly, the distance from the first fold, $F_1$, to the corresponding first edge 52 can be larger than the distance from the second fold, $F_2$, to the corresponding second edge 54. Moreover, each of these respective distances to the folds are less than the width, W, of the tri-folded structure.

Figure 8:
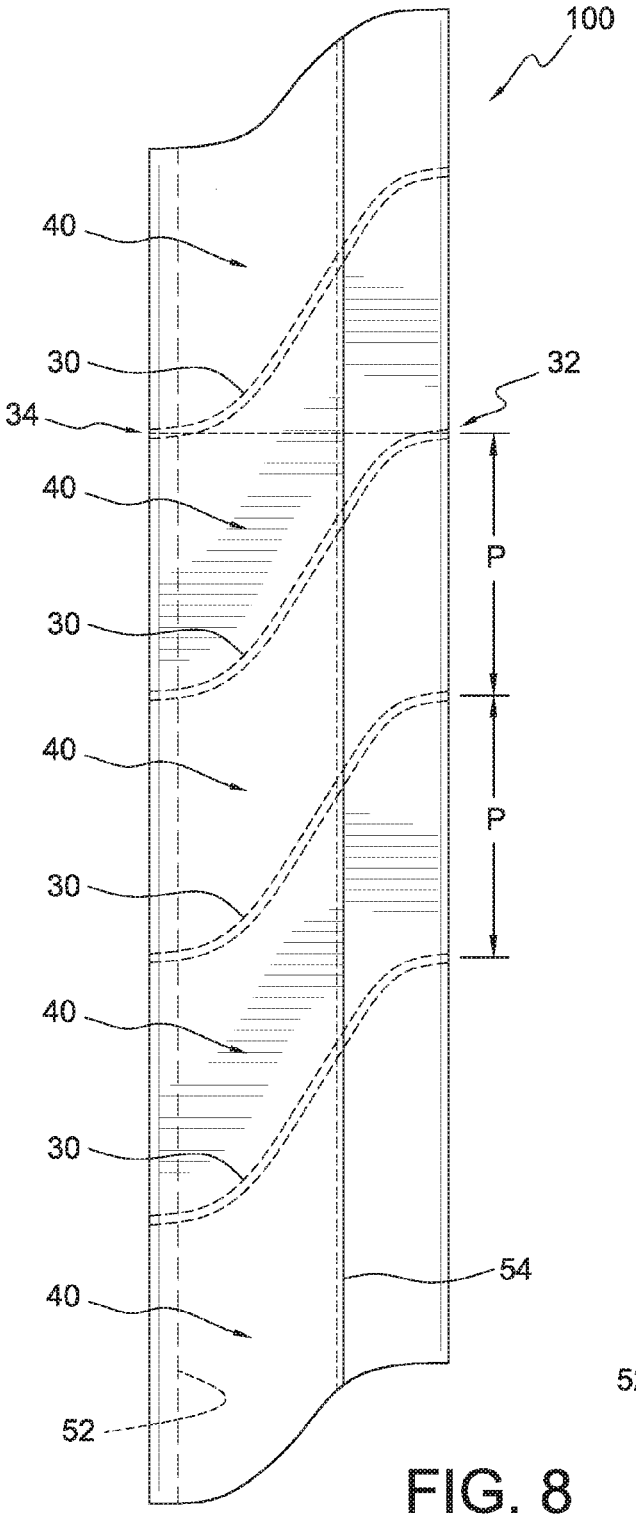

Referring now to FIG. 8, after the aforementioned folding steps, a plurality of dividers 30 can be implemented onto the tri-folded fabric 50. The plurality of dividers 30 can extend generally across the width of the baffled chamber bathing device 100. The plurality of dividers 30 create a series of baffled chambers 40 into which the soap segments 80 can be inserted and held. During bathing, the soap segments 80 are securely held within the baffled chambers 40 by the tri-folded design.

According to various embodiments, one or more of the dividers 30 can include a general S-shape as shown in at least FIG. 8. The dividers 30 can be sewn into the fabric 50 or secured in any manner as would be appreciated by one of ordinary skill in the art. The dividers 30 can be evenly spaced along the length of the baffled chamber bathing device 100. Each of the dividers 30 forming the baffled chambers 40 can be spaced by a pocket spacing, P. For example, each of the pocket spacings, P, can be from about 6 inches to about 9 inches, and preferably, the pocket spacings, P, can be about 7.5 inches. As shown in FIG. 8, the pocket spacing, P, of each neighboring pair of S-shaped dividers 30 can be substantially consistent along the length of the respective neighboring S-shaped dividers 30.

Moreover, geometrically opposing ends of neighboring S-shaped dividers 30 can be arranged to be substantially aligned across the width of the baffled chamber bathing device 100. For example, as shown in FIG. 8, an end 32 of first S-shaped divider 30 on one side of the bathing device 100 can be substantially aligned with the start 34 of neighboring S-shaped divider 30 on the other side of the bathing device 100. This geometric alignment between neighboring S-shaped dividers 30, along with the tri-fold design, helps to fully trap and encase a soap segment 80 inserted within a respective baffled chamber 40.

Figure 9:
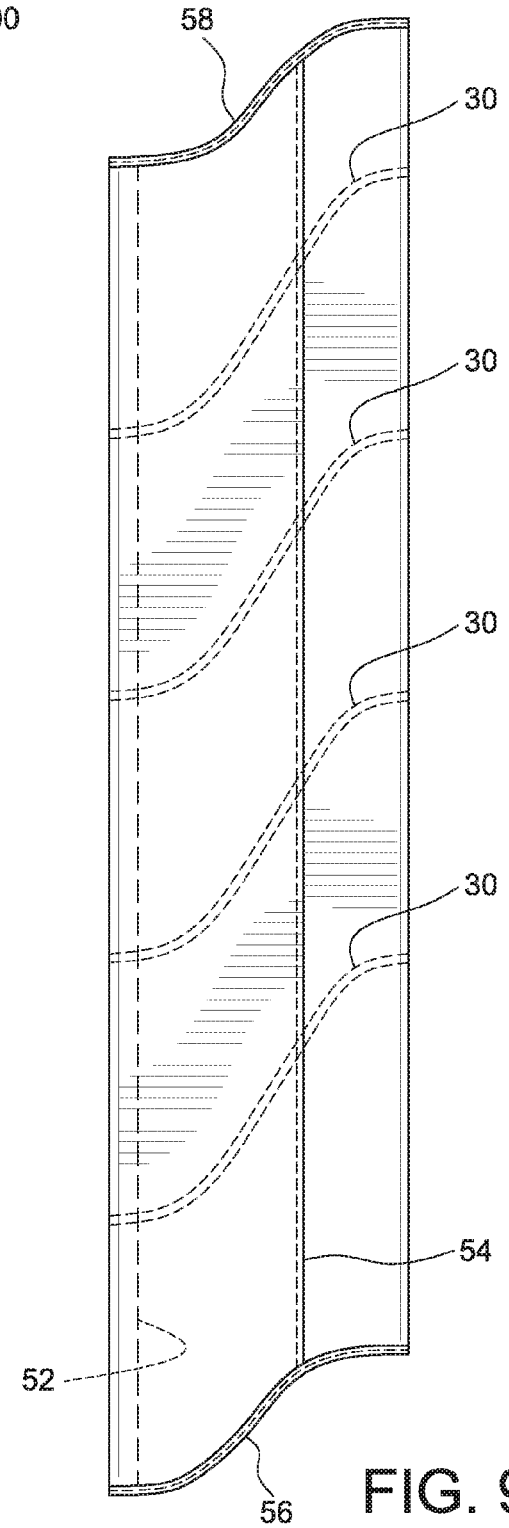

As shown in FIG. 9, each respective longitudinal end 56, 58 of the baffled chamber bathing device 100 can be double-stitched or triple stitched. Each divider 30 can also be double-stitched or triple stitched. The double or triple stitched dividers can 30 can include a width of about 0.25 inches. In addition, the longitudinal ends 56, 58 of the baffled chamber bathing device 100 can include a shape to match the shape of the dividers 30. For example, the longitudinal ends 56, 58 can include an S-shape to match the S-shape of the dividers 30. The use of S-shaped longitudinal ends 56, 58 can provide areas for a user to grab the baffled chamber bathing device 100 during use, as shown in FIG. 2.

Figure 10:
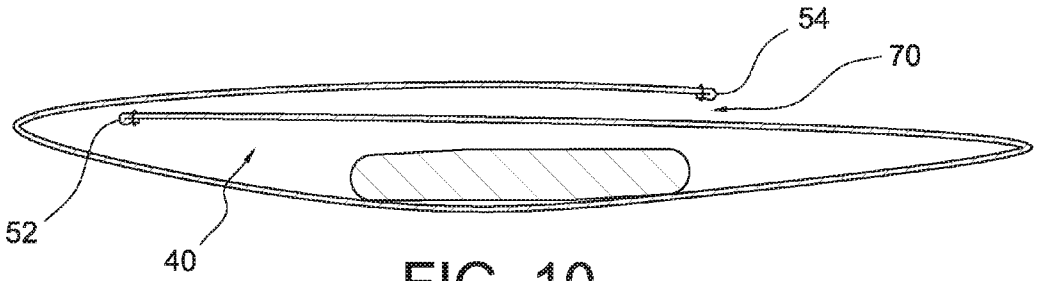
FIG. 10 shows a side cross-sectional view of the bathing device through line 10-10 of FIG. 3.
Figure 11:
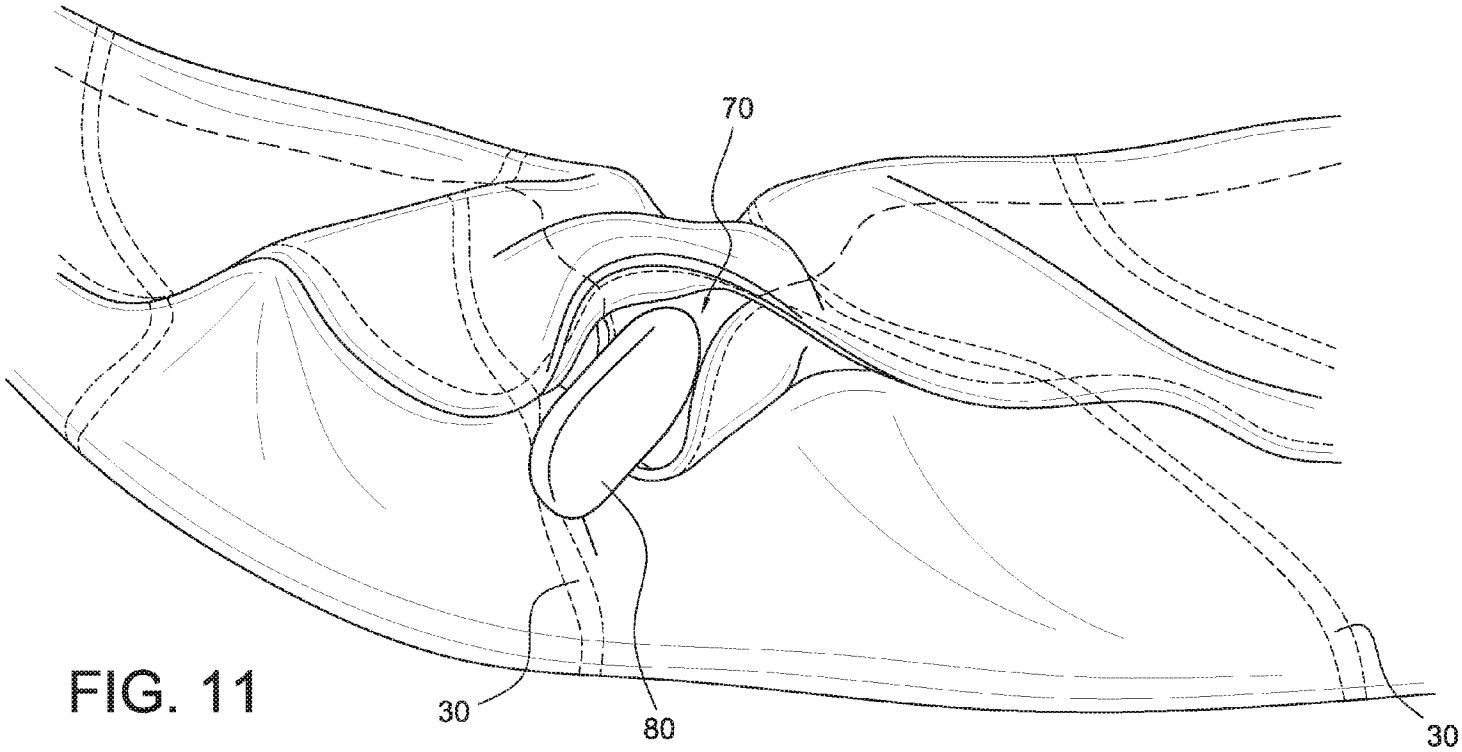
FIG. 11 shows a bar of soap being inserted into an opened pocket of the baffled chamber bathing device of the present teachings.

Referring to FIGS. 10 and 11, an opening 70 into a corresponding baffled chamber 40 is shown. A soap segment 80 can be inserted into the opening 70 and securely held within the baffled chamber 40 formed by the tri-folded structure and the neighboring S-shaped dividers 30. The baffled chamber bathing device 100 of the present teachings can be used with soap segments 80 including soap shards, general pieces of soap, small or full-sized bars of soap, and the like. FIG. 10 shows a single soap segment 80 being held within the tri-fold baffled chamber 40 and illustrates how the tri-fold design traps and encases the soap segment and prevents the accidental removal of the soap segment during use. FIG. 11 shows how the soap segment 80 can be inserted through the opening 70 and into the single baffled chamber 40 by manipulating the tri-folded fabric 50 between the S-shaped dividers 30 to gain entry into the interior of the baffled chamber 40.

The tri-fold design and the S-shaped dividers 30 of the baffled chamber bathing device 100 of the present teachings prevents the need for securing mechanisms, such as snaps, buttons, ties, hook-and-loop fasteners, and the like. The baffled chamber bathing device 100 contains and secures the soap segments after each use and then drips dry until its subsequent use.

The baffled chamber bathing device 100 of the present teachings can be made of ramie, nylon, rayon, and/or a bamboo-type fabric, or any other type of fabric which is textured, crimped, porous, and drips dry. The texture of the material can vary from coarse to mild depending on the desired degree of coarseness or softness for achieving skin cleansing and debridement, soap lathering, and pliability.

In use, a user inserts soap shards, pieces of soap, or small or full-sized bar soap 80 into one or more of the baffled chambers 40 of the bathing device 100. The user then wets the bathing device 100 to create a lather in preparation to wash themselves. The length of the bathing device 100 can be arranged to enable a user to grip either end to reach and wash their respective back (or other body portion), as shown in FIG. 2. When done bathing, the user can hang the bathing device 100 to drip dry until the next use. A loop or similar device 90 can be arranged on the bathing device 100 to allow it to be hung when not in use.

The baffled chamber bathing device 100 of the present teachings can make full use of small slivers and shards of soap normally discarded and can also fit hotel-size and full-size soap bars. The bathing device 100 can offer many health benefits including maintaining skin health, cleanliness, and epidermal massage and debridement, fosters skin circulation, deep cleans, lathers soap instantly and drips dry, and does not need frequent laundering. The bathing device 100 is portable which can be convenient for first responders, athletes, campers, hikers, travelers, students and even inmates in communal bathing situations with shared facilities. The fabric functions by exfoliating dead dry skin cells and stimulates dermal circulation promoting new skin growth and removes dirt and debris from skin surface all while being stylish in its form or fabric pattern. The length of the bathing device allows for hard to reach back bathing by allowing gripping of both ends. The bathing device 100 creates a skin cleaning and exfoliating system that is unique, functional, and invigorating.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A baffled chamber bathing device comprising:

a generally elongated piece of porous fabric having a length and a first edge and a second edge, the piece of porous fabric folded along its length along a first fold and a second fold thereby forming a tri-folded structure having a width; and at least one curvilinear lateral divider extending laterally across substantially the entire width of the tri-folded structure and defining a plurality of baffled chambers within the tri-folded structure;

wherein each of the plurality of baffled chambers created by the tri-folded structure and the at least one curvilinear lateral divider includes an opening into which a soap segment is capable of being inserted and securely held within the respective baffled chambers by the tri-folded structure.

2. The baffled chamber bathing device of claim 1, wherein the at least one curvilinear lateral divider encompasses two curvilinear lateral dividers that are equidistantly spaced along the length of the piece of fabric.

3. The baffled chamber bathing device of claim 2, wherein a spacing between a neighboring pair of curvilinear lateral dividers is substantially constant along an entire length of the respective neighboring curvilinear lateral dividers.

4. The baffled chamber bathing device of claim 3, wherein the equidistantly spaced curvilinear lateral dividers are substantially S-shaped.

5. The baffled chamber bathing device of claim 1, wherein the at least one curvilinear lateral divider is substantially S-shaped.

6. The baffled chamber bathing device of claim 5, wherein the at least one curvilinear lateral divider encompasses two substantially S-shaped lateral dividers and a spacing between a neighboring pair of substantially S-shaped dividers is substantially constant along an entire length of the respective neighboring substantially S-shaped dividers.

7. The baffled chamber bathing device of claim 6, wherein opposed ends of the at least two substantially S-shaped dividers are substantially aligned across the width of the tri-folded structure.

8. The baffled chamber bathing device of claim 1, wherein the tri-folded structure includes a first and a second longitudinal end and at least one of the first and second longitudinal ends includes a shape that substantially matches that of the at least one curvilinear lateral divider and forms an area for a user to grab the baffled chamber bathing device during use.

9. The baffled chamber bathing device of claim 1, wherein the tri-folded structure is folded along the first fold and the second fold in an manner that forms an exterior gap between the second edge and the first fold to create the opening into each respective baffled chamber.

10. A baffled chamber bathing device comprising:

a generally elongated piece of fabric folded along a first fold ($F_1$) and a second fold ($F_2$) to create a tri-folded structure having a width, each of the first fold ($F_1$) and the second fold ($F_2$) being located a different distance from a respective first edge and second edge of the elongated piece of fabric and each distance being less than the width of the tri-folded structure; and at least one curvilinear lateral divider extending laterally across substantially the entire width of the tri-folded structure and defining a plurality of baffled chambers within the tri-folded structure;

wherein each of the plurality of baffled chambers created by the tri-folded structure and the at least one curvilinear lateral divider includes an opening into which a soap segment is capable of being inserted and securely held within the respective baffled chambers by the tri-folded structure.

11. The baffled chamber bathing device of claim 10, wherein the distance from the first fold ($F_1$) to the corresponding first edge being larger than the distance from the second fold ($F_2$) to the corresponding second edge.

12. The baffled chamber bathing device of claim 10, wherein the at least one curvilinear lateral divider encompasses two curvilinear lateral dividers that are equidistantly spaced along the length of the piece of fabric.

13. The baffled chamber bathing device of claim 12, wherein a spacing between a neighboring pair of curvilinear lateral dividers is substantially constant along an entire length of the respective neighboring curvilinear lateral dividers.

14. The baffled chamber bathing device of claim 13, wherein the equidistantly spaced curvilinear lateral dividers are substantially S-shaped.

15. The baffled chamber bathing device of claim 10, wherein the at least one curvilinear lateral divider is substantially S-shaped.

16. The baffled chamber bathing device of claim 15, wherein the at least one curvilinear lateral divider encompasses two substantially S-shaped lateral dividers and a spacing between a neighboring pair of substantially S-shaped dividers is substantially constant along an entire length of the respective neighboring substantially S-shaped dividers.

17. The baffled chamber bathing device of claim 16, wherein opposed ends of the at least two substantially S-shaped dividers are substantially aligned across the width of the tri-folded structure.

18. The baffled chamber bathing device of claim 10, wherein the tri-folded structure includes a first and a second longitudinal end and at least one of the first and second longitudinal ends includes a shape that substantially matches that of the at least one curvilinear lateral divider to thereby form an area for a user to grab the baffled chamber bathing device during use.

19. A method of making a baffled chamber bathing device comprising:

providing a generally elongated piece of fabric;

folding the piece of fabric along a first fold ($F_1$) located at a first distance from a corresponding first edge of the elongated piece of fabric;

folding the piece of fabric along a second fold ($F_2$) located at a second distance from a corresponding second edge of the elongated piece of fabric and different from the first distance to thereby create a tri-folded structure having a width; and providing at least one curvilinear lateral divider extending laterally across the width of the tri-folded structure and defining a plurality of baffled chambers within the tri-folded structure;

wherein each of the first distance and the second distance are less than the width of the tri-folded structure whereby an exterior gap is formed between the second edge and the first fold; and wherein each of the plurality of baffled chambers created by the tri-folded structure and the at least one curvilinear lateral divider includes an opening formed by the exterior gap into which a soap segment is capable of being inserted and securely held within the respective baffled chambers by the tri-folded structure.

20. The method of making a baffled chamber bathing device of claim 19, wherein the at least one curvilinear lateral divider is substantially S-shaped.

21. The method of making a baffled chamber bathing device of claim 20, wherein the tri-folded structure includes a first and a second longitudinal end and at least one of the first and second longitudinal ends includes a shape that substantially matches that of the at least one curvilinear lateral divider to thereby form an area for a user to grab the baffled chamber bathing device during use.

22. A baffled chamber bathing device comprising:

a generally elongated piece of porous fabric having a length, the piece of porous fabric folded along its length along a first fold and a second fold thereby forming a tri-folded structure having a width; and a plurality of dividers each extending laterally across the width of the tri-folded structure and defining a plurality of baffled chambers within the tri-folded structure;

wherein at least one of the plurality of baffled chambers created by the tri-folded structure and the plurality of dividers includes an opening into which a soap segment is capable of being inserted and securely held within the respective baffled chambers by the tri-folded structure;

wherein at least two of the plurality of dividers are substantially S-shaped;

wherein a spacing between a neighboring pair of substantially S-shaped dividers is substantially constant along an entire length of the respective neighboring substantially S-shaped dividers; and wherein opposed ends of the at least two substantially S-shaped dividers are substantially aligned across the width of the tri-folded structure.

* * * * *